US006935079B1

(12) United States Patent
Julian et al.

(10) Patent No.: US 6,935,079 B1
(45) Date of Patent: Aug. 30, 2005

(54) METAL STUD GUARD

(76) Inventors: Casey James Julian, 2651 NW. 62nd Ter., Margate, FL (US) 33063; Cathy A. Julian, 2651 NW. 62nd Ter., Margate, FL (US) 33063

( * ) Notice: Subject to any disclaimer, the term of this patent is extended or adjusted under 35 U.S.C. 154(b) by 0 days.

(21) Appl. No.: 10/455,731

(22) Filed: Jun. 6, 2003

(51) Int. Cl.[7] ..... E04B 9/00; E04F 13/04

(52) U.S. Cl. ..... 52/357; 52/359; 52/363; 52/362

(58) Field of Search ..... 52/702, 220.1, 52/220.3, 220.2, 220.8, 514, 741.3, 712, 357, 359, 363, 362; 174/48, 135

(56) References Cited

U.S. PATENT DOCUMENTS

| | | | | | |
|---|---|---|---|---|---|
| 3,211,824 | A | | 10/1965 | Heiman | |
| 4,011,704 | A | * | 3/1977 | O'Konski | 52/733.3 |
| 4,050,205 | A | | 9/1977 | Ligda | |
| D264,683 | S | | 6/1982 | Searer | |
| 4,870,794 | A | * | 10/1989 | Menchetti | 52/281 |
| 4,924,646 | A | | 5/1990 | Marquardt | |
| 5,163,254 | A | | 11/1992 | Zastrow et al. | |
| 5,245,811 | A | * | 9/1993 | Knorr | 52/481.1 |
| 5,359,151 | A | | 10/1994 | Nattel et al. | |
| 5,595,453 | A | | 1/1997 | Nattel et al. | |
| 5,622,356 | A | | 4/1997 | Duggan | |
| 6,176,057 | B1 | * | 1/2001 | Bouchet et al. | 52/514 |
| 6,766,992 | B1 | * | 7/2004 | Parker | 248/300 |

* cited by examiner

*Primary Examiner*—Carl D. Friedman
*Assistant Examiner*—Chi Q. Nguyen
(74) *Attorney, Agent, or Firm*—Oltman, Flynn & Kubler

(57) ABSTRACT

A rigid guard for a metal wall stud comprising a flat outer wall with apertures for accommodating fasteners to affix it to the outer side of a wall stud, a first pair of flanges extending perpendicularly from one edge of the outer wall at upper and lower ends of the guard, and a second pair of flanges extending perpendicularly from an opposite edge of the outer wall at the upper and lower ends of the guard and each carrying a laterally inturned lip on its free end.

1 Claim, 1 Drawing Sheet

METAL STUD GUARD

BACKGROUND OF THE INVENTION

1. Field of the Invention

This invention relates to a guard for attachment to a metal stud in the framework of a building wall to protect water pipes or electrical wiring in the wall from damage by screws or other fasteners that attach wallboard to the stud.

2. Prior Art

Heretofore, various guards have been proposed which straddle the wallboard-facing outer side of a metal stud in a building wall framework to protect water pipes or electrical wiring from damage by screws used to attach the wallboard to the stud. Some employ a resilient gripping action of the guard itself to hold the guard on the stud, e.g., U.S. Pat. No. 4,050,205 to Ligda, and FIGS. 11–18 of Nattel et al 5,359,151. Another way of attaching the guard to the stud is by using bendable elements on the guard to grip the stud: integral metal tabs on the guard in all embodiments of Nattel et al 5,359,151; exposed ends of a pressure sensitive adhesive tape on the guard of Zastrow et al 5,163,254.

Nattel et al 5,595,453 show a guard that fits inside the metal stud where it has an opening for passing a water pipe or wiring.

Guards designed for wooden studs are shown in Marquardt 4,924,646 and Heiman 3,211,824.

SUMMARY OF THE INVENTION

The present invention is a guard having: a flat, rigid, vertically elongated outer wall dimensioned to cover the wallboard-facing outer side of a wall stud; flat, rigid first flanges at the upper and lower ends extending perpendicularly inward from the outer wall at one of its longitudinal edges; rigid second flanges at the upper and lower ends extending perpendicularly inward from the outer wall at its opposite longitudinal edge and carrying respective laterally inturned lips on their free ends which extend parallel to the outer wall; and apertures in the outer wall, preferably notches in its longitudinal edge adjacent the second flanges for accommodating small screws to affix the guard to the stud. The guard has a snap-on fit with the stud, with its flanges engaging corresponding surfaces of the stud and its outer wall engaging the outer face of the stud.

A principal object of this invention is to provide a novel rigid guard that is conveniently attachable to a metal wall stud to protect water pipes and/or electrical wiring from the screws or other fasteners used in attaching wallboard to the stud.

Further objects and advantages of this invention will be apparent from the following detailed description of a presently preferred embodiment thereof, with reference to the accompanying drawings.

DETAILED DESCRIPTION OF THE INVENTION

Before explaining the present invention in detail it is to be understood that the invention is not limited in its application to the particular arrangement shown and described since the invention is capable of other embodiments. Also, the terminology used herein is for the purpose of description and not of limitation.

Figure 1:
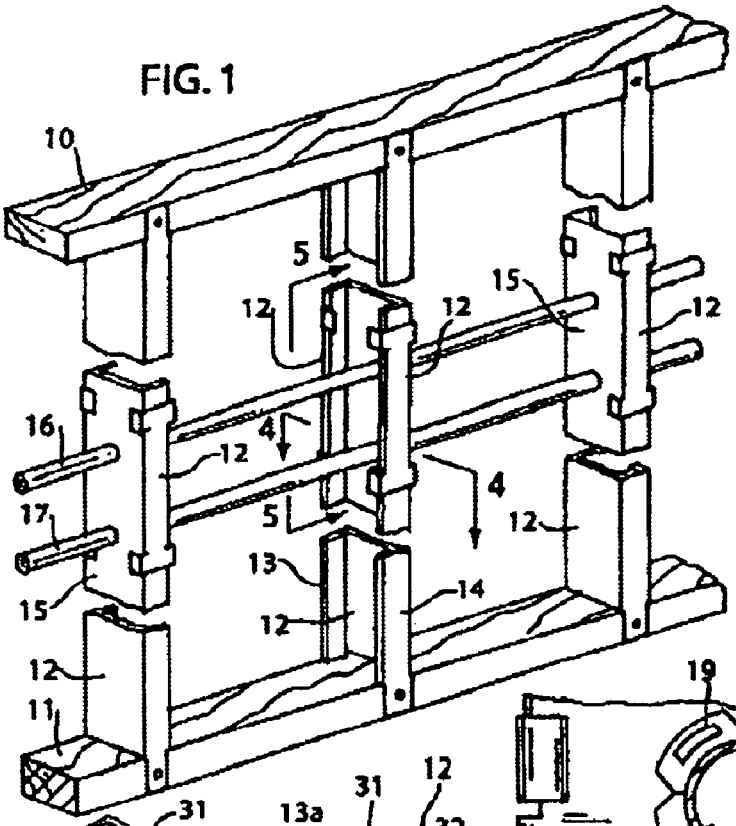
FIG. 1 is a perspective view of the framework of a building wall, partly broken away, with several of the present guards on metal studs of the framework.

FIG. 1 shows a typical framework of a building wall having a horizontally elongated wall plate 10 of wood along the top, a horizontally elongated wood sill 11 along the bottom extending parallel to the wall plate, and a plurality of steel studs 12 extending vertically between them at predetermined intervals.

Figure 4:
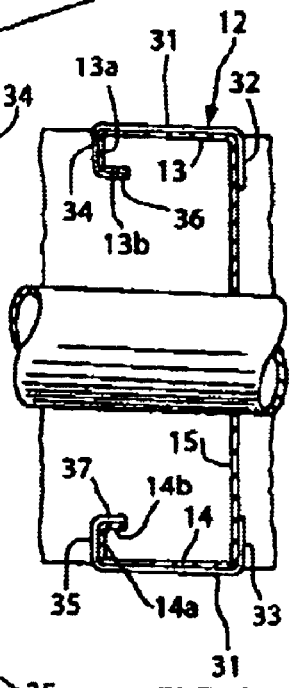
FIG. 4 is a horizontal cross-section taken along the line 4—4 in FIG. 1.

As best seen in FIG. 4, each stud has a generally channel-shaped cross section, with flat, parallel, opposite sides 13 and 14 connected to opposite longitudinal edges of a flat web 15 that extends perpendicularly between them. As shown in FIG. 1, each side 13 and 14 faces outward on the corresponding side of the wall framework for engagement by a corresponding wallboard (not shown) in the finished wall. At its longitudinal edge away from the web 15, side 13 of the stud is joined at a right angle to an inwardly projecting flat flange 13*a* extending parallel to web 15 and carrying on its free end a perpendicularly disposed, inturned lip 13*b* that projects back toward web 15 perpendicular to it. The other side 14 of the stud is a mirror image of the just-described side 13, carrying an inwardly projecting flange 14*a* along its edge away from web 15 that extends parallel to web 15 and has a perpendicularly disposed, inturned lip 14*b* on its free end projecting back toward the web at a right angle.

Figure 5:
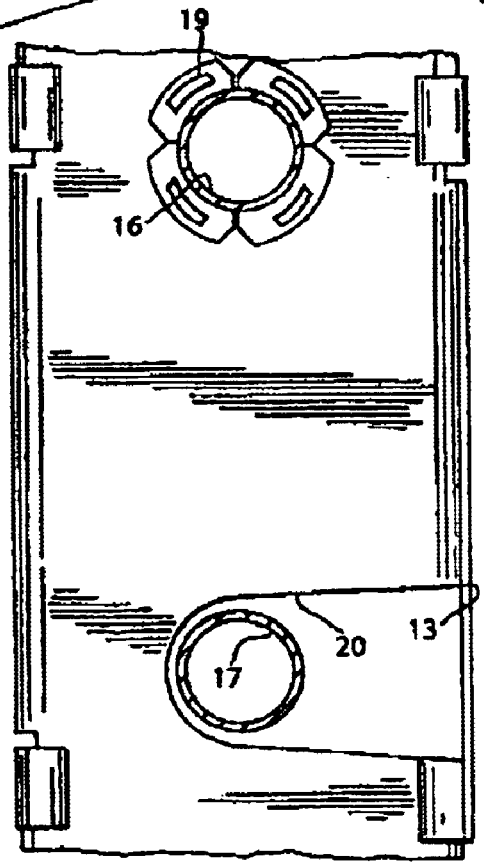
FIG. 5 is a vertical cross-section taken along the line 5—5 in FIG. 1.

FIG. 1 shows water pipes 16 and 17 of copper extending through respective openings in the web 15 of each of the wall studs. In the wall stud shown in FIG. 5, the opening for the upper pipe 16 is a circular opening 18 in which is seated an annular collar 19 of known design for holding this pipe, and the opening for the lower pipe 17 is a cutout 20 in web 15 which is open at side 13.

Figure 2:
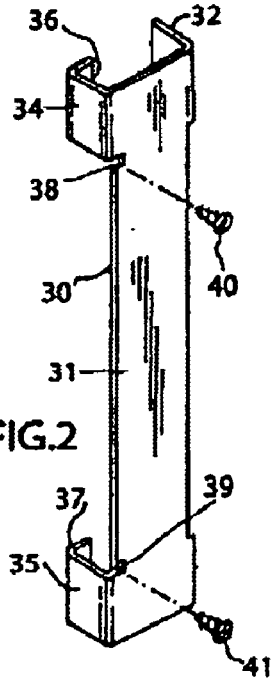
FIG. 2 is a perspective view of the guard of the present invention taken from its outer side and showing screws for affixing it to a metal stud as shown in FIG. 1.
Figure 3:
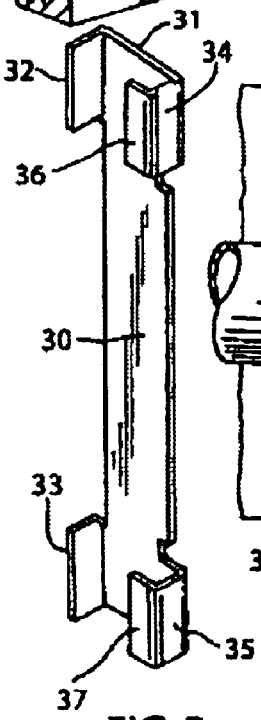
FIG. 3 is a perspective view of this guard taken from its inner side.

As shown in FIGS. 2 and 3, the stud guard 30 of the present invention has an elongated, flat, rigid outer wall 31 that is dimensioned to completely cover the selected side 13 or 14 of the stud on the outside for a predetermined portion of the stud's height. A first pair of flat rigid flanges 32 and 33 extend perpendicularly inward from one longitudinal edge of the outer wall 31 at its opposite (upper and lower) ends. Each of these flanges is positioned and dimensioned to overlie the outside of web 15 on the stud. A second pair or rigid flanges 34 and 35 extend perpendicularly inward from the opposite longitudinal edge of the outer wall 31, and away from the outer wall 31 they terminate respectively in laterally inturned, flat, rigid lips 36 and 37 that extend parallel to the outer wall 31. The second flanges 34 and 35 are positioned and dimensioned to engage the outside face of flange 13*a* on the wall stud, and their inturned lips 36 and 37 are positioned and dimensioned to engage the outside of lip 13*b* on the wall stud. The outer wall 31 of the guard has apertures for accommodating fasteners, such as screws, to affix it permanently to the stud. Preferably, these apertures are rectangular notches 38 and 39 formed in its longitudinal edge next to the second flanges 34 and 35.

In one practical embodiment the outer wall 31 of guard 30 is 6 inches long and 1.3 inches wide, each of the first flanges 32 and 33 projects 0.5 inch from the outer wall 31, each of the second flanges 34 and 35 projects 0.31 inch from outer wall 31; and each lip 36 and 37 extends laterally inward 0.31 inch from the corresponding second flange 34 or 35.

Guard 30 is attached to the wall stud 13 with a snap-on fit by first engaging its lipped second flanges 34,36 and 35,37 against the outside of the lipped flange 13*a,* 13*b* of the stud and then turning the guard to force its flat first flanges 32 and 33 slidably across the outside of web 15 on the stud. After it is attached, the guard 30 has a snug fit on the outside of the wall stud. The guard then is permanently is affixed to the wall stud by small self-tapping screws 40 and 41 inserted through the notches 38 and 39 in the outer wall 31 of the guard.

From this detailed description and the accompanying drawings it will be evident that the guard of the present invention can be readily and conveniently attached to a wall stud to provide reliable protection against damage to pipes or wiring inside the finished wall.

We claim:

1. A guard for attachment to a metal stud in the framework of a building wall to protect water pipes and electrical wiring in said wall from damage by a fastener attaching wallboard to said stud, said guard comprising: an elongated flat, rigid outer wall dimensioned to substantially cover the wallboard-facing outer side of the stud; a first pair of flat rigid flanges extending perpendicularly inward from a first longitudinal edge of said outer wall at its opposite ends; a second pair of rigid flanges extending perpendicularly inward from the opposite longitudinal edge of said outer wall at its opposite ends, each of said second flanges terminating away from said outer wall in a laterally inturned flat rigid lip extending parallel to said outer wall; and said outer wall having at least one aperture therein for receiving a fastener to affix the guard to said wallboard-facing outer side of the stud, said outer wall having two of said apertures respectively located toward its opposite ends, wherein said apertures are notches formed in said longitudinal edges of said outer plate next to the flanges of said second pair.

* * * * *